US008506310B2

(12) United States Patent
Brandberg

(10) Patent No.: US 8,506,310 B2
(45) Date of Patent: Aug. 13, 2013

(54) CONNECTOR FOR ELECTRIFIED CEILING GRID AND METHOD OF INSTALLING THE SAME

(75) Inventor: Philip Clay Brandberg, Carlisle, PA (US)

(73) Assignee: Tyco Electronics Corporation, Berwyn, PA (US)

( * ) Notice: Subject to any disclaimer, the term of this patent is extended or adjusted under 35 U.S.C. 154(b) by 0 days.

(21) Appl. No.: 13/309,600

(22) Filed: Dec. 2, 2011

(65) Prior Publication Data

US 2013/0143436 A1 Jun. 6, 2013

(51) Int. Cl.
*H01R 25/14* (2006.01)

(52) U.S. Cl.
USPC ..... 439/122; 439/117

(58) Field of Classification Search
USPC ..... 439/116–118, 122
See application file for complete search history.

(56) References Cited

U.S. PATENT DOCUMENTS

| | | | | |
|---|---|---|---|---|
| 2,924,687 | A | | 2/1960 | Platz |
| 3,710,530 | A | | 1/1973 | Valtonen |
| 3,813,633 | A | | 5/1974 | Clement |
| 3,898,782 | A | | 8/1975 | Donato |
| 4,088,293 | A | | 5/1978 | Delmore |
| 4,203,053 | A | | 5/1980 | Shepard |
| 4,218,108 | A | | 8/1980 | El Mouchi |
| 4,286,419 | A | | 9/1981 | Treffers |
| 4,646,212 | A | | 2/1987 | Florence |
| 4,699,439 | A | | 10/1987 | Cohen |
| 4,736,564 | A | | 4/1988 | Gailey |
| 4,790,766 | A | * | 12/1988 | Booty et al. ..... 439/122 |
| 4,831,273 | A | | 5/1989 | Ross et al. |
| 5,033,247 | A | | 7/1991 | Clunn |
| 5,072,344 | A | | 12/1991 | Fabbri |
| 5,128,847 | A | * | 7/1992 | Lin et al. ..... 362/648 |
| 5,334,037 | A | * | 8/1994 | Gabrius et al. ..... 439/118 |
| 5,390,461 | A | | 2/1995 | Dwyer |
| 5,561,271 | A | | 10/1996 | Bruck et al. |
| 5,653,412 | A | | 8/1997 | Martorano et al. |
| 5,788,518 | A | | 8/1998 | Wachter et al. |
| 5,855,485 | A | | 1/1999 | Patti |
| 6,004,005 | A | | 12/1999 | Demshki, Jr. |

(Continued)

FOREIGN PATENT DOCUMENTS

| | | | |
|---|---|---|---|
| DE | 10300857 | A1 | 7/2004 |
| DE | 202005020919 | U1 | 12/2006 |

(Continued)

OTHER PUBLICATIONS

International Search Report, International Application No. PCTUS2012/066170, International Filing Date, Nov. 21, 2012.

(Continued)

*Primary Examiner* — Gary F. Paumen

(57) ABSTRACT

A connector for installation on a grid having conductors therein and a method of installation therefore. The connector has a housing with at least one contact mounted in the housing which makes an electrical connection with the conductors of the grid when the connector is mated with the grid. At least one mounting member is movable between a first position in which a grid mounting section of the at least one mounting member is positioned in the housing and a second position in which the grid mounting section extends beyond a top surface of the housing to provide a mechanical connection between the grid and the connector.

17 Claims, 5 Drawing Sheets

(56) References Cited

U.S. PATENT DOCUMENTS

| | | | | |
|---|---|---|---|---|
| 6,079,992 | A | 6/2000 | Kuchar et al. | |
| 6,170,967 | B1 | 1/2001 | Usher et al. | |
| 6,857,883 | B2 | 2/2005 | Tang | |
| 6,884,095 | B1 * | 4/2005 | Tsai | 439/121 |
| 7,351,075 | B1 | 4/2008 | Patterson et al. | |
| 7,758,358 | B1 | 7/2010 | Mier-Langner et al. | |
| 2003/0137835 | A1 | 7/2003 | Mier-Langner et al. | |
| 2004/0213003 | A1 | 10/2004 | Lauderdale et al. | |
| 2006/0035518 | A1 | 2/2006 | Hueber | |
| 2006/0272256 | A1 | 12/2006 | Frecska et al. | |
| 2007/0103824 | A1 | 5/2007 | Patterson et al. | |
| 2008/0087464 | A1 | 4/2008 | Patterson et al. | |
| 2008/0090432 | A1 | 4/2008 | Patterson et al. | |
| 2010/0015824 | A1 | 1/2010 | Wang et al. | |

FOREIGN PATENT DOCUMENTS

| | | | |
|---|---|---|---|
| EP | 0 322 203 | A2 | 6/1989 |
| EP | 0560445 | A1 | 9/1993 |
| EP | 1 076 384 | A1 | 2/2001 |
| EP | 2 248 503 | A1 | 11/2010 |
| EP | 2249442 | A1 | 11/2010 |
| FR | 2832748 | A1 | 5/2003 |
| GB | 1 588 540 | A | 4/1981 |
| WO | 98/51963 | A2 | 11/1998 |
| WO | 2009/128909 | A1 | 10/2009 |

OTHER PUBLICATIONS

International Search Report, International Application No. PCT/US2012/066028, International Filing Date, Nov. 20, 2012.

International Search Report, International Application No. PCT/US2012/066089, International Filing Date, Nov. 20, 2012.

* cited by examiner

CONNECTOR FOR ELECTRIFIED CEILING GRID AND METHOD OF INSTALLING THE SAME

FIELD OF THE INVENTION

The present invention is directed to connectors, and, more particularly, to connectors for making low voltage direct current electrical connections between conductive elements of an electrified grid.

BACKGROUND OF THE INVENTION

The electrical grid connecting America's power plants, transmission lines and substations to homes, businesses and factories operate almost entirely within the realm of high voltage alternating current (AC). Yet, an increasing fraction of devices found in those buildings actually operate on low voltage direct current (DC). Those devices include, but are not limited to, digital displays, remote controls, touch-sensitive controls, transmitters, receivers, timers, light emitting diodes (LEDs), audio amplifiers, microprocessors, other digital electronics and virtually all products utilizing rechargeable or disposable batteries.

Installation of devices utilizing low voltage DC has been typically limited to locations in which a pair of wires is routed from the voltage source. Increased versatility in placement and powering of low voltage DC products is desirable. Specifically, there is an increasing desire to have electrical functionality, such as power and signal transmission, in the interior building environment, and specifically in the ceiling environment, without the drawbacks of existing systems.

Commercial building spaces such as offices, laboratories, light manufacturing facilities, health facilities, meeting and banquet hall facilities, educational facilities, common areas in hotels, apartments, retirement homes, retail stores, restaurants and the like are commonly constructed with suspended ceilings. These suspended ceiling installations are ubiquitous, owing to their many recognized benefits. Such ceilings ordinarily comprise a rectangular open grid suspended by wire from a superstructure and tile or panels carried by the grid and enclosing the open spaces between the grid elements.

Many relatively low power devices are now supported on such ceilings and newer electronic devices and appliances are continuously being developed and adopted for mounting on ceilings. The ceiling structure, of course, typically overlies the entire floor space of an occupiable area. This allows the ceiling to support electronic devices where they are needed in the occupied space. Buildings are becoming more intelligent in energy management of space conditioning, lighting, noise control, security, and other applications. The appliances that provide these features including sensors, actuators, transducers, speakers, cameras, recorders, in general, all utilize low voltage DC power.

A conventional grid framework, such as one used in a surface covering system, includes main grid elements intersected by cross grid elements therebetween. The main and cross elements form a grid of polygonal openings into which components such as panels, light fixtures, speakers, motion detectors and the like can be inserted and supported. Known systems that provide electrification to devices, such as lighting components, in conventional framework systems utilize a means of routing discrete wires or cables, principally on an "as needed" point-to-point basis via conduits, cable trays and electrical junctions located in the space behind the grid framework.

These known systems suffer from the drawback that the network of wires required occupy the limited space behind the grid framework and are difficult to service or reconfigure. Moreover, the techniques currently used are limited in that the electricity that is provided is not reasonably accessible from all directions relative to the framework plane. For example, electricity can be easily accessed from a ceiling plenum, but not from areas within or below the plane of the grid framework of a suspended ceiling system. Further, the electrical power levels that are typically available are not safe to work with for those not trained, licensed and/or certified.

In known systems utilizing track systems, the connecting devices have terminals that provide electrical connections to conductors provided in a track. These tracks also typically require wiring and mechanical support from the area behind the grid framework. In addition, existing track systems are typically viewable from the room space and are aesthetically undesirable. Further still, known track systems typically utilize higher voltage AC power and connect to AC powered devices, requiring specialized installation and maintenance.

In an effort to overcome some of the problems with prior systems, internal bus bars have been positioned in the ceiling grid. One such system is described in the documents related to the Emerge Alliance. Such systems provide electrical power through two parallel bus bars embedded with the support rails of a suspended ceiling. Electrical connectors are mated with the bus bars to supply power to various low voltage devices. However, these connectors are often difficult to install or they are expensive and complicated to manufacture and assembly.

What is needed are connectors which can be terminated to a grid framework system that provides low voltage DC power connections that can be safely utilized from all angles relative the plane of the grid framework. The present invention accomplishes this need and provides additional advantages.

SUMMARY OF THE INVENTION

An exemplary embodiment is directed to a connector for installation on a ceiling grid having conductors therein. The connector having a housing with a projection fixedly mounted to a surface of the housing. A contact is mounted in the housing, the contact having contact arms which extend from the projection. Contact portions of the contact arms are positioned to make an electrical connection with the conductors of the ceiling grid when the connector is mated with the ceiling grid. At least one mounting member is movable between a first position in which a grid mounting section of the at least one mounting member is positioned in the housing and a second position in which the grid mounting section extends beyond the surface of the housing. The at least one mounting member is rotatable to allow the grid mounting section to engage the ceiling grid and provide a mechanical connection between the ceiling grid and the connector.

An exemplary embodiment is also directed to a connector for installation on a grid having conductors therein. The connector has a housing with at least one contact mounted in the housing. The at least one contact has contact arms which extend from a surface of the housing. Contact portions of the contact arms are positioned to make an electrical connection with the conductors of the ceiling grid when the connector is mated with the ceiling grid. At least one mounting member is movable between a first position in which a grid mounting section of the at least one mounting member is positioned in the housing and a second position in which the grid mounting section extends beyond the surface of the housing to provide a mechanical connection between the ceiling grid and the connector.

An exemplary embodiment is also directed to a method of installing an electrical connector assembly to a ceiling grid element having conductors therein. The exemplary method comprising: moving the connector assembly toward the grid element such that a longitudinal axis of the connector assembly is positioned essentially perpendicular to a longitudinal axis of the grid element; inserting a projection of the connector assembly between flanges of the grid element; and rotating the connector assembly and the projection such that the longitudinal axis of the connector assembly is positioned essentially parallel to and in the same plane, as the longitudinal axis of the grid element. As the connector assembly and the projection are rotated, contact portions of contact terminals which extend from the projection engage the conductors of the grid element to make an electrical connection therebetween.

Other features and advantages of the present invention will be apparent from the following more detailed description of the preferred embodiment, taken in conjunction with the accompanying drawings which illustrate, by way of example, the principles of the invention.

BRIEF DESCRIPTION OF THE DRAWINGS

Wherever possible, the same reference numbers will be used throughout the drawings to refer to the same or like parts.

DETAILED DESCRIPTION OF THE INVENTION

Figure 1:
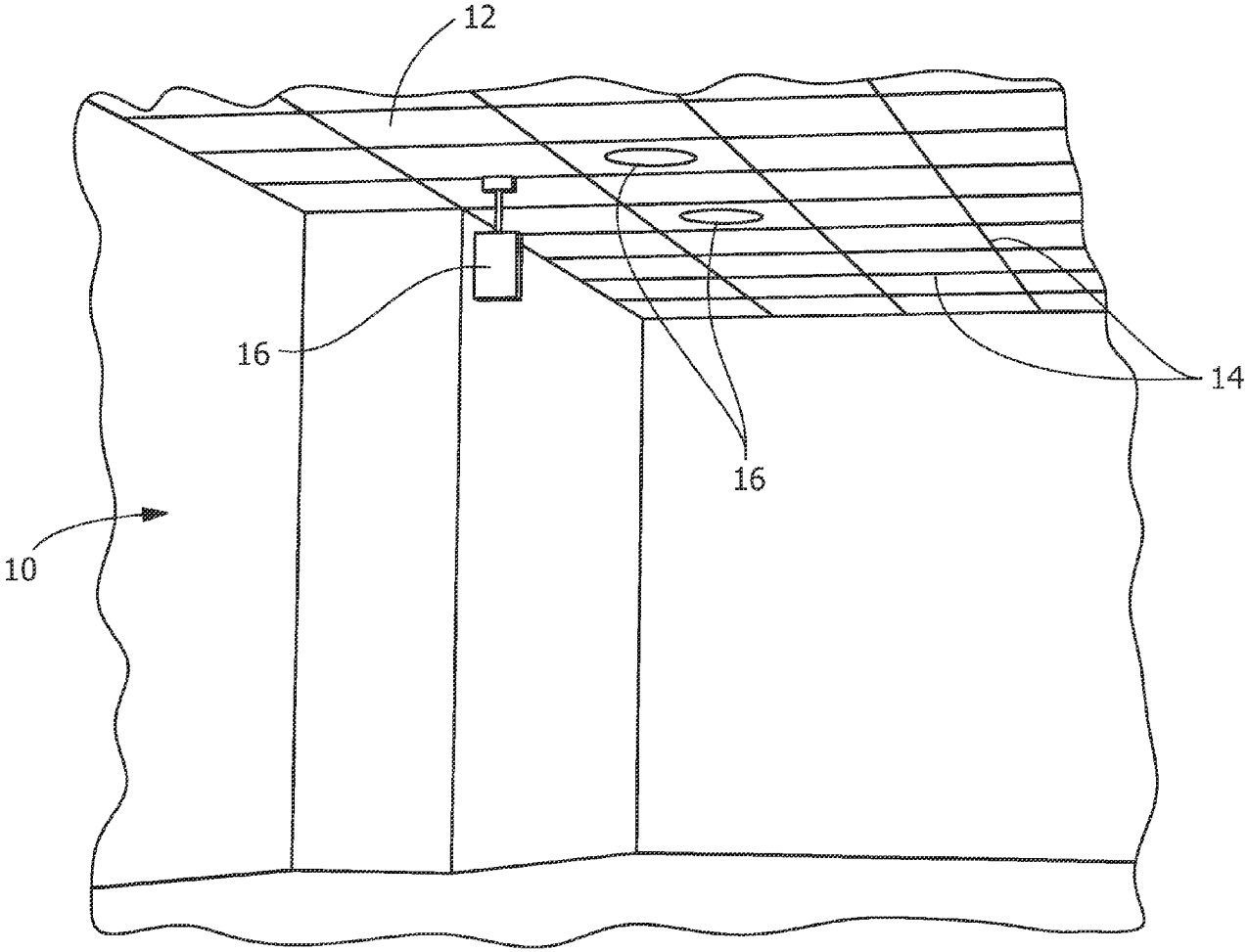
FIG. 1 shows a perspective view of a room space having an electrified ceiling according into which a connector can be inserted and electrically engaged.

The present invention will be described more fully hereinafter with reference to the accompanying drawings, in which illustrative embodiments of the invention are shown. In the drawings, the relative sizes of regions or features may be exaggerated for clarity. This invention may, however, be embodied in many different forms and should not be construed as limited to the embodiments set forth herein; rather, these embodiments are provided so that this disclosure will be thorough and complete, and will fully convey the scope of the invention to those skilled in the art.

It will be understood that spatially relative terms, such as "top", "upper", "lower" and the like, may be used herein for ease of description to describe one element's or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "over" other elements or features would then be oriented "under" the other elements or features. Thus, the exemplary term "over" can encompass both an orientation of over and under. The device may be otherwise oriented (rotated 90 degrees or at other orientations) and the spatially relative descriptors used herein interpreted accordingly.

The present invention is directed to connectors for use with an electrified framework or ceiling grid. For illustrative purposes, FIG. 1 shows a room space 10 having a ceiling 12 supported by a ceiling grid framework 14. However, any system having a grid framework, including floors and wall, can utilize the technology of the invention. The ceiling 12 may include decorative tiles, acoustical tiles, insulative tiles, lights, heating ventilation and air conditioning (HVAC) vents, other ceiling elements or covers and combinations thereof. Power for low voltage devices 16 attached to or suspended from the ceiling 12 or framework 14 is provided by the conductive material placed upon the ceiling grid framework 14. Low voltage devices 16, such as, but not limited to, light emitting diode (LED) lights, speakers, smoke or carbon monoxide detectors, wireless access points, still or video cameras, or other low voltage devices, may be utilized with the electrified ceiling.

Figure 2:
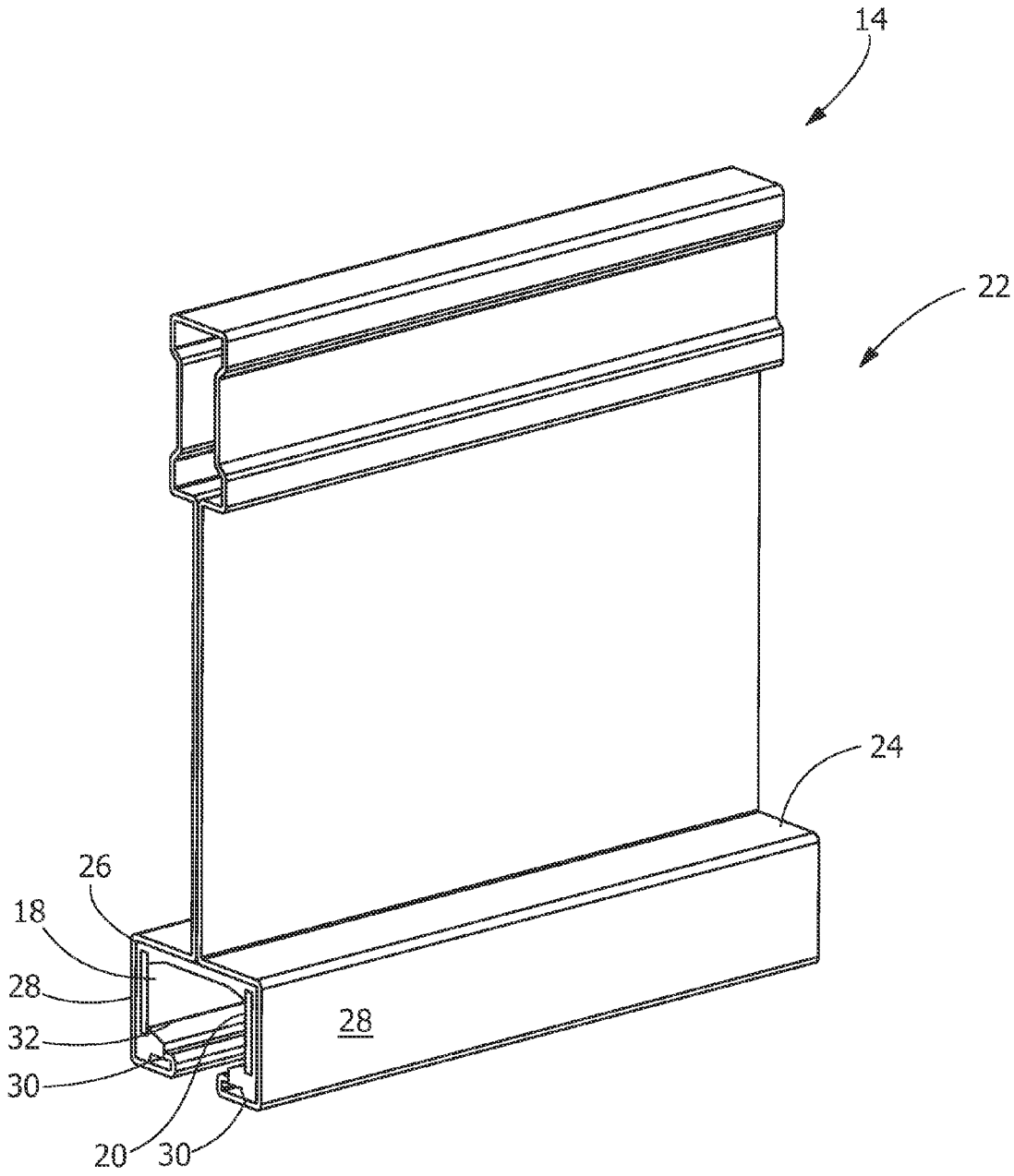
FIG. 2 shows a perspective view of a section of an exemplary grid member which can be used in the electrified ceiling of FIG. 1.
Figure 3:
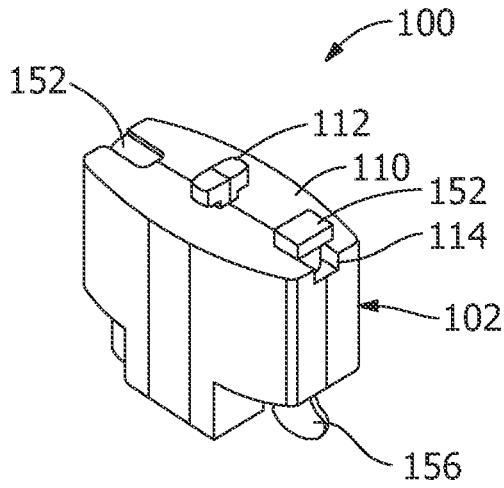
FIG. 3 shows a perspective view of an exemplary connector according to an exemplary embodiment.
Figure 4:
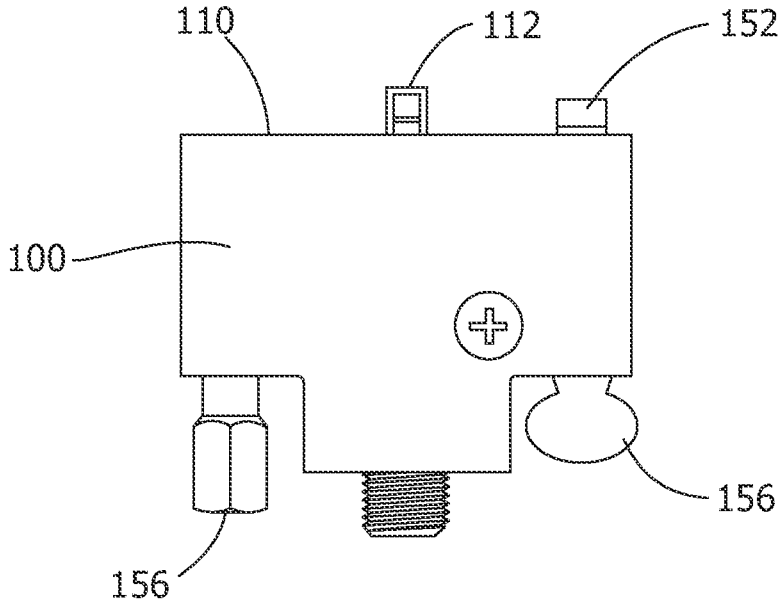
FIG. 4 shows a front elevational view of the exemplary connector of FIG. 3.

In the exemplary embodiment shown, conductive material is disposed on a surface of at least one of the plurality of grid members. In the exemplary embodiment shown in FIG. 2, first and second conductive strips 18 and 20 are disposed on a grid element 22 of the grid framework 14. The conductive strips 18 and 20 have opposite polarity, i.e. one is positive and one is negative. The conductors 18, 20 are housed inside the lower box 24 of the grid element 22. More specifically, in the exemplary embodiment shown, the conventional lower box 24 configuration typically has a base wall 26, a pair of side walls 28 and a pair of flanges 30 that define a slot 32 therebetween. Conductors 18, 20 which are positioned on respective surfaces of the pair of sidewalls 28.

One or more connectors 100 are provided to electrically connect the devices 16 to the grid elements 22 of the grid framework 14. For example, a connector assembly 100 provides a low voltage electrical connection between the conductors 18, on the grid framework 14 and a device 16 such as a light.

As shown in FIGS. 3 through 8, an exemplary connector assembly 100 for making a low voltage electrical connection between one or more devices 16 and conductors 18, 20 housed inside the lower box 24 of a grid element 22 is provided. The connector assembly 100 provides the electrical interface required and the flexibility of attaching the connector assembly 100 to the box 24 of a respective grid element 22 at any position along the length of the grid box 24. In addition, the connector assembly 100 provides a robust mechanical connection with the grid element 22 and an electrical connection between the conductors 18, 20 and various devices 16.

Figure 7:
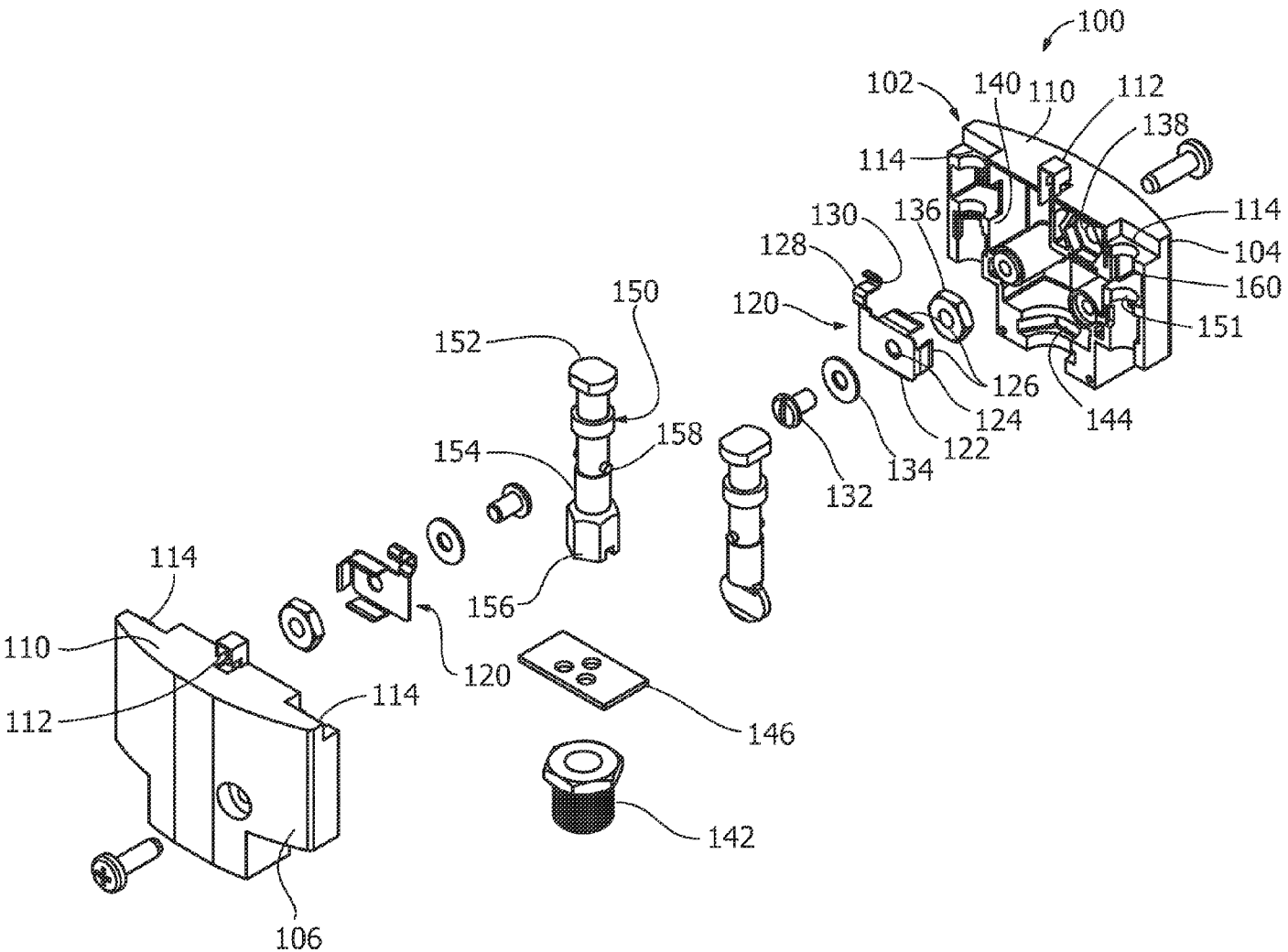
FIG. 7 shows an exploded view of the exemplary connector.

Referring to FIG. 7, the exemplary connector assembly 100 includes a connector housing 102 comprising two halves 104 and 106. The connector halves 104, 106 are essentially identical, with connector half 104 being turned 180 degrees relative to connector half 106. Therefore, for ease of explanation only connector half 104 will be described in detail. However, as the connector halves 104, 106 are identical, the detailed description of connection half 104 is equally applicable for connector half 106.

Each housing is molded from plastic or other material having the strength and electrically insulative properties required. Connector half 104 has a top surface 110 which is configured to about against or be positioned proximate a respective flange 30 of the grid element 22, as will be more fully described. The top surface 110 has a contact projection 112 which extends therefrom. In the exemplary embodiment shown, the contact projection 112 is positioned at the midpoint of the longitudinal axis of the top surface 110. Openings 114 extend through the top surface 110. In the exemplary embodiment shown, the openings 114 are positioned proximate the ends of the top surface 110 and are spaced equally from the contact projection 112. Other positioning of the contact projections 112 and openings 114 can be used without departing from the scope of the invention.

A contact 120 is secured in each contact half 104, 106. As best shown in FIG. 7, each contact 120 has a mounting portion 122 which has an opening 124 extending therethrough. First contact arms 126 extend from the mounting portion 122. The first contact arms 126 are pressed into respective cavities in the housing half 104, 106 providing proper location and attachment to housing half 104, 106. A second contact arm 128 extends from the mounting portion 122. The second contact arm 128 has a contact portion 130 which is positioned proximate the contact projection 112. The second contact arm 128 and the contact portion 130 are configured to have resilient characteristics.

Mounting hardware 132, 134, 136 extends through the opening 124 to mount the contact 120 to the housing half 104, 106. Nut 136 is positioned in a recess 138 to provide the required retention of the nut 136 relative to the housing half. This configuration captures the nut 136 in a recess 138, whereby, if the connector 100 must be opened in the field, the mounting hardware 132, 134, nut 136, and contact 120 will not fall out.

A device mounting hardware 142, which in the exemplary embodiment is in the form of a hex nut with threads, is mounted in the housing 102. Recesses 144 in each half 104, 106 maintain the mounting hardware 142 in position. A strain relief plate 146 is provided proximate the mounting hardware 142 so wires may be inserted through the strain relief plate 146 to provide proper strain relief. In one exemplary embodiment, two wires (not shown) may be attached between the mounting hardware 132 and 134 and routed through the strain relief plate 146 and through the mounting hardware 142 to a respective external low voltage device 16.

Mounting members 150 are positioned in mounting areas 151 of the housing 102. In the exemplary embodiment, two mounting members 150 are provided proximate the ends of the connector housing 102. Each mounting member 150 has a grid mounting section 152, a connector mounting section 154 and an operator engagement section 156.

Each mounting section 154 is mounted in the housing with section 152 extending through respective opening 114 of housing 102 and section 156 extending through an opening provided on a bottom surface of the housing 102. The mounting sections 154 have projections 158 which extend therefrom. The projections 158 cooperate with walls of the mounting areas 151 of the housing to limit the movement of the mounting members 150. In the embodiment shown, the projections 158 cause the rotation of the mounting member 150 to be limited to approximately 90 degrees. The projections 158 are mounted in cavities 160 of the housing 102. The projections 158 are allowed to move up and down, as viewed in FIG. 8, in the cavities 160. This allows the grid engagement sections 152 to be moved between the first position in which the sections 152 are positioned within the housing 102 and the second position in which the sections 152 extend beyond the top surface 110 of the housing 102.

When installing the connector assembly 100 on a respective grid element 22, the connector assembly 100 is moved toward the grid element 22. As this occurs, the longitudinal axis of the assembly 100 is positioned essentially perpendicular to the longitudinal axis of the box 24 of the grid element 22. As assembly 100 is moved toward grid element 22, the grid engagement sections 152 of members 150 are maintained within the housing 102. Projection 112 extends from the top surface 110.

Figure 5:
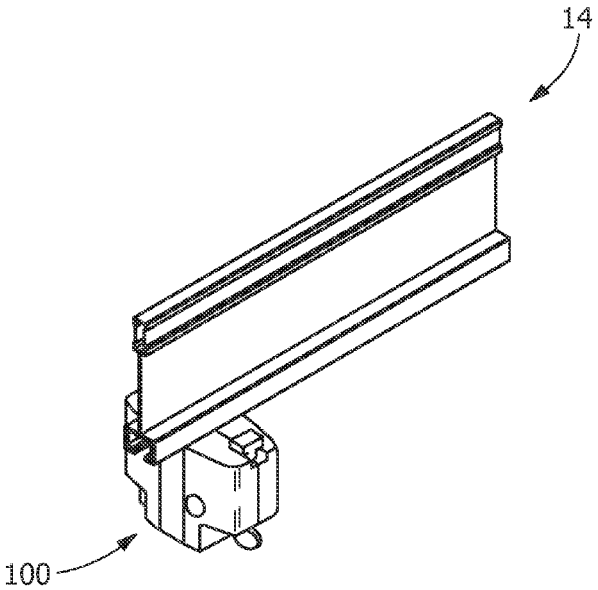
FIG. 5 shows a perspective view of the exemplary connector as the connector is moved into engagement with an exemplary grid member.

As best shown in FIG. 5, as insertion continues, projection 112 is inserted between flanges 30 into slot 32 of box 24. Insertion continues until the top surface 110 of the connector assembly 100 is in contiguous relation with the pair of flanges 30 of the box 24 which define the slot, such that the projection 112 is properly positioned in the slot 32. Other methods of insuring proper position of the projection 112 may be used, such as, but not limited to, the top of the projection 112 engaging the base wall 26.

With the projection 112 properly inserted into the slot 32, the assembly 100 is rotated such that the longitudinal axis of the assembly 100 is positioned essentially parallel to and in the same plane, as the longitudinal axis of the grid element 22. As the rotation occurs, the contact portions 130 of the contact arms 128, which extend from the sides of the projection 112, engage the conductors 18, 20 of the box 24. As the contact arms 128 are resiliently deformable inward, the contact arms 128 of the contacts 120 will provide sufficient force to maintain a positive electrical connection between the conductors 18, 20 and the contact portions 130. The resiliency of the contact arms 128 also allows the contact arms 128 and contact portions 130 to compensate for any irregularities in the conductors 18, 20. As the contact portions 130 are rotated with the assembly 100, the rotation of the contact portions 130 relative to the conductors 18, 20 provides a wiping action therebetween. This removes any oxides, coatings or other debris that is present on the contact portions 130 or the conductors 18, 20. In addition to providing an electrical interface, the projections 112 cooperate with the flange 30 to prevent the withdraw of the projections 112 from the slot 32, thereby providing a mechanical interface to maintain the assembly 100 in position relative to the grid element 22.

Figure 6:
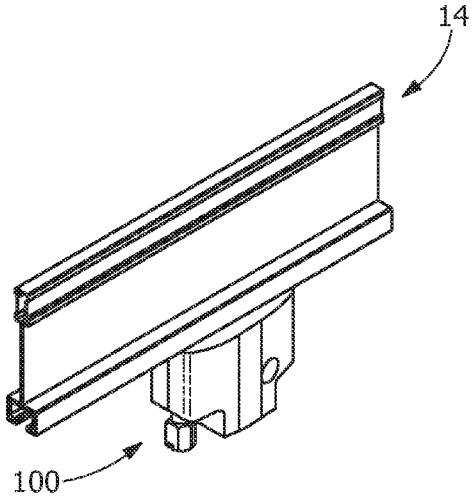
FIG. 6 shows a perspective view of the exemplary connector as the connector is fully inserted into the exemplary grid member.
Figure 8:
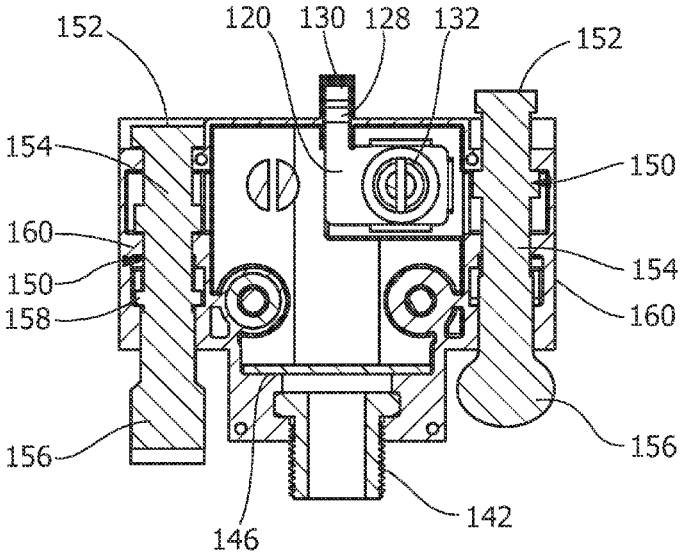
FIG. 8 is a cross-sectional view showing a first mounting member in a first position and a second mounting member in a second position.

Referring to FIG. 6, with the assembly 100 properly rotated, the members 150 are moved such that the engagement sections 152 extend beyond the top surface 110 of housing 102. As the engagement sections 152 are extended, the longitudinal axis of the engagement sections 152 are positioned essentially parallel to the longitudinal axis of the box 24 of the grid element 22. As insertion continues, engagement sections 152 are inserted between flanges 30 into slot 32 of box 24. With the engagement sections 152 properly inserted into the slot 32, the members 150 and engagement sections 152 are rotated such that the longitudinal axis of the engagement sections 152 are positioned essentially perpendicular to and in the same plane, as the longitudinal axis of the grid element 22. In order to rotate the members 150, an operator or tool engages the engagement section 156 and is rotated. As the rotation occurs, the engagement sections 152 cooperate with the flanges 30 to prevent the withdraw of the engagement sections 152 from the slot 32, thereby providing a mechanical interface to maintain the assembly 100 in position relative to the grid element 22.

With the assembly 100 properly mounted to the grid element 22, a low voltage electrical device may be mounted to the assembly 100 at mounting hardware 142, thereby establishing an electrical connection between the conductors 18, 20 and the low voltage device by means of contact 120, contact plate and mounting hardware 142. The cooperation of the projection 112 and engagement sections 152 of members 150 with the grid element 22 provide sufficient mechanical support to allow the low voltage device to hang from the assembly 100 and grid element 22.

The assembly 100 is designed to hold a low voltage electrical device fixture and carry low voltage current thereto. In alternate exemplary embodiments, a conventional threaded component can be attached at the bottom of the housing 102 to hold a fixture such as a camera or lighting device. In addition, the housing 102 may include miscellaneous conventional fixture mounting hardware such as strain reliefs, nipples, etc. for attaching the low voltage electrical device, such as a pendant light, to the assembly 100. In other exemplary embodiments, the low voltage electrical device may have wires which must be electrically connected to wires or contact pads of the assembly 100. In such applications the wires may be inserted through the mounting hardware 142 and through the strain relief plate 146 to provide proper strain relief The ends of the wires may then be attached by placing them under and tightening screws or using other conventional means. The low voltage electrical device wires are then threaded through the fixture mounting hardware.

If the device is no longer needed, the device may be removed from the assembly 100. The assembly 100 may then be removed from the grid element 22. Alternatively, the assembly 100 may be removed from the grid element with the device still attached. In order to remove the assembly 100, the members 150 must be rotated to allow the longitudinal axis of the engagement sections 152 to be positioned essentially parallel to and in the same plane, as the longitudinal axis of the grid element 22. An operator or tool engages the engagement section 156 and is rotated to cause the rotation of the engagement sections 152. As the rotation occurs, the engagement sections 152 disengages the flanges 30 to allow for the withdraw of the engagement sections 152 from the slot 32. With the engagement sections 152 properly rotated, the members 150 are moved such that the engagement sections 152 retract into the housing 102.

With the engagement sections 152 retracted, the assembly 100 is rotated such that the longitudinal axis of the assembly 100 is essentially parallel to and in the same plane, as the longitudinal axis of the grid element 22. As the rotation occurs, the projection 112 disengages, both electrically and mechanically, from the flanges 30 to allow for the withdraw of the projection 112 from the slot 32. The projection 112 is then moved away from the grid element 22 and the assembly 100 is removed from the grid element 22.

There are various advantages associated with the type of assembly described herein and represented by the exemplary embodiment of assembly 100. Installation of the assembly onto the grid is intuitive and can be accomplished by trained installers and consumers alike. In addition, as the installation and removal of the connector does not damage the connector or the grid, the connector may be used over many cycles and for various devices.

As the projection and contacts are used to provide the electrical connection, the contacts can be configured to optimize the electrical connection to the conductors of the grid element. This allows the contacts to compensate for tolerances associated with the grid box. In addition, as the contacts are rotated, the contacts provide a wiping action to facilitate and maintain a stable electrical connection with the conductors. Once inserted into the grid element, the contacts are concealed and protected from damage.

With the engagement sections properly positioned and rotated into position, the engagement sections provide the mechanical connection required to maintain the assembly and device connected thereto in position. This allows the mechanical load on the contacts to be minimized, thereby allowing less material to be used for the contacts.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

The invention claimed is:

1. A connector for installation on a ceiling grid having conductors therein, the connector comprising:

a housing with a projection fixedly mounted to a surface of the housing, the housing having a device mating contact provided to make electrical engagement with a low voltage device;

contacts mounted in the housing, the contacts having contact arms which extend from the projection, contact portions of the contact arms positioned to make an electrical connection with the conductors of the ceiling grid when the connector is mated with the ceiling grid;

at least one mounting member movable between a first position in which a grid mounting section of the at least one mounting member is positioned in the housing and a second position in which the grid mounting section extends beyond the surface of the housing, the at least one mounting member being rotatable to allow the grid mounting section to engage the ceiling grid and provide a mechanical connection between the ceiling grid and the connector.

2. The connector as recited in claim 1, wherein the projection is positioned at the midpoint of the longitudinal axis of the surface of the housing.

3. The connector as recited in claim 1, wherein the device mating contact is configured to provide a mechanical engagement between the connector and the low voltage device.

4. The connector as recited in claim 1, wherein the at least one mounting member is positioned in mounting areas of the housing, with the at least one mounting member having the grid mounting section, a connector mounting section and an operator engagement section.

5. The connector as recited in claim 4, wherein the connector mounting section has connector mounting projections which cooperate with walls of the mounting areas of the housing to limit the movement of the mounting members.

6. The connector as recited in claim 5, wherein the connector mounting projections limit rotation of the mounting member to approximately 90 degrees.

7. The connector as recited in claim 5, wherein the connector mounting projections are mounted in cavities of the housing which limit the movement of the connector mounting member between the first and the second position.

8. The connector as recited in claim 6, wherein the operator engagement section extends through an opening of the housing, thereby allowing an operator to properly manipulate the at least one mounting member.

9. A connector for installation on a grid having conductors therein, the connector comprising:

a housing with at least one contact mounted in the housing, the at least one contact having contact arms which extend from a surface of the housing, contact portions of the contact arms positioned to make an electrical connection with the conductors of the ceiling grid when the connector is mated with the ceiling grid;

at least two mounting members movable between a first position in which a grid mounting sections of the at least two mounting members are positioned in the housing and a second position in which the grid mounting sections extends beyond the surface of the housing to provide a mechanical connection between the ceiling grid and the connector, the at least two mounting members being movable independently from each other.

10. The connector as recited in claim 9, wherein the at least one two mounting members are rotatable to allow the grid mounting sections to engage the grid.

11. The connector as recited in claim 9, wherein a device mating contact is provided on the housing, the device mating contact provided to make electrical engagement with the a low voltage device.

12. A method of installing an electrical connector assembly to a ceiling grid element having conductors therein, the method comprising:

moving the connector assembly toward the grid element such that a longitudinal axis of the connector assembly is positioned essentially perpendicular to a longitudinal axis of the grid element;

inserting a projection of the connector assembly between flanges of the grid element;

rotating the connector assembly and the projection such that the longitudinal axis of the connector assembly is positioned essentially parallel to and in the same plane, as the longitudinal axis of the grid element;

mounting a low voltage electrical device to the connector assembly;

whereby as the connector assembly and the projection are rotated, contact portions of contact terminals which extend from the projection engage the conductors of the grid element to make an electrical connection therebetween.

13. The method of installing an electrical connector assembly as recited in claim 12, further comprising:

moving a mounting section of a first mounting member between the flanges of the grid element and rotating the mounting section allowing the mounting section to cooperate with the flanges to prevent the withdraw of the mounting section from the flanges, thereby providing a mechanical interface to maintain the connector assembly in position relative to the grid element.

14. The method of installing an electrical connector assembly as recited in claim 13, further comprising:

moving a mounting section of a second mounting member between the flanges of the grid element and rotating the mounting section of the second mounting member allowing the mounting section of the second mounting member to cooperate with the flanges to prevent the withdraw of the mounting section of the second mounting member from the flanges, thereby providing a mechanical interface to maintain the connector assembly in position relative to the grid element.

15. The method of installing an electrical connector assembly as recited in claim 14, wherein the mounting sections of the first and second mounting members are rotated such that a longitudinal axis of the each of the mounting sections is positioned essentially perpendicular to and in the same plane as the longitudinal axis of the grid element.

16. The method of installing an electrical connector assembly as recited in claim 12, wherein the insertion of the projection of the connector assembly between the flanges of the grid element continues until a top surface of the connector assembly is in contiguous relation with the flanges of the grid element, thereby positioning the projection is a slot provided in the grid element.

17. The method of installing an electrical connector assembly as recited in claim 12, wherein the contact portions of the contact terminals are resiliently deformable inward, the contact terminals provide a sufficient force to maintain a positive electrical connection between the conductors of the grid element and the contact portions of the contact terminals.

* * * * *